US009898950B2

(12) United States Patent
Cao et al.

(10) Patent No.: US 9,898,950 B2
(45) Date of Patent: Feb. 20, 2018

(54) DISPLAY PANEL DEVICE

(71) Applicants: SHANGHAI TIANMA MICRO-ELECTRONICS CO., LTD., Shanghai (CN); TIANMA MICRO-ELECTRONICS CO., LTD., Shanghai (CN)

(72) Inventors: Zhaokeng Cao, Shanghai (CN); Tingting Cui, Shanghai (CN); Dandan Qin, Shanghai (CN)

(73) Assignees: SHANGHAI TIANMA MICRO-ELECTRONICS CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 11 days.

(21) Appl. No.: 14/859,921

(22) Filed: Sep. 21, 2015

(65) Prior Publication Data

US 2016/0171919 A1 Jun. 16, 2016

(30) Foreign Application Priority Data

Dec. 10, 2014 (CN) ..... 2014 1 0756774

(51) Int. Cl.
*G09G 3/20* (2006.01)

(52) U.S. Cl.
CPC ..... *G09G 3/20* (2013.01); *G09G 2300/0426* (2013.01); *G09G 2310/0202* (2013.01); (Continued)

(58) Field of Classification Search
CPC ..... G09G 3/20; G09G 2320/0252; G09G 2320/0209; G09G 2300/0426; G09G 2310/0202; G09G 2310/0251
See application file for complete search history.

(56) References Cited

U.S. PATENT DOCUMENTS 7,561,138 B2 * 7/2009 Byun ..... G09G 3/3677 345/87
8,026,883 B2 9/2011 Meng et al.
(Continued)

FOREIGN PATENT DOCUMENTS

CN 101192383 A 6/2008
CN 101539698 A 9/2009
(Continued)

OTHER PUBLICATIONS

Office Action as issued in corresponding Chinese Application No. 201410756774.7, dated May 30, 2016.

*Primary Examiner* — Mihir K Rayan
(74) *Attorney, Agent, or Firm* — Alston & Bird LLP

(57) ABSTRACT

A display panel and an electronic device are provided. The display panel includes: multiple pixel units arranged in an array; multiple data lines for providing data signals for the pixel units; multiple gate lines for providing gate scanning signals for the pixel units; and at least one enhancing region, where at least one gate signal enhancing transistor and at least one of the pixel units are disposed in the enhancing region, the gate signal enhancing transistor is configured to pre-charge a gate line for a pixel row where the gate signal enhancing transistor is located. An electronic device including the display panel has a quick response speed and a narrow border region.

14 Claims, 4 Drawing Sheets

(52) U.S. Cl.
CPC ..... *G09G 2310/0251* (2013.01); *G09G 2320/0209* (2013.01); *G09G 2320/0252* (2013.01)

(56) References Cited

U.S. PATENT DOCUMENTS

| | | | | |
|---|---|---|---|---|
| 9,378,689 | B2 * | 6/2016 | Ahn | G09G 3/3607 |
| 9,378,698 | B2 * | 6/2016 | Wang | G09G 3/3677 |
| 2002/0089525 | A1 * | 7/2002 | Huang | G09G 5/005 345/698 |
| 2003/0086045 | A1 | 5/2003 | Ono et al. | |
| 2005/0057465 | A1 * | 3/2005 | Yu | G09G 3/3655 345/87 |
| 2008/0273155 | A1 | 11/2008 | Maeda et al. | |
| 2009/0195521 | A1 * | 8/2009 | Chen | G09G 3/30 345/204 |
| 2011/0018846 | A1 * | 1/2011 | Hu | G02F 1/136286 345/204 |
| 2012/0127110 | A1 * | 5/2012 | Amm | G06F 3/03545 345/174 |
| 2013/0321252 | A1 | 12/2013 | Hu et al. | |
| 2015/0116386 | A1 * | 4/2015 | Shin | G09G 3/3688 345/694 |
| 2016/0133652 | A1 * | 5/2016 | Cao | G02F 1/136286 257/72 |

FOREIGN PATENT DOCUMENTS

| | | | | |
|---|---|---|---|---|
| CN | 101963724 | A | 2/2011 | |
| KR | 10-0444538 | B1 | 8/2004 | |
| WO | WO2015010382 | * | 1/2015 | G09G 3/3677 |

* cited by examiner

DISPLAY PANEL DEVICE

CROSS REFERENCE TO RELATED APPLICATIONS

The present application claims the priority to Chinese Patent Application No. 201410756774.7, entitled "DISPLAY PANEL AND ELECTRONIC DEVICE", filed on Dec. 10, 2014 with the State Intellectual Property Office of People's Republic of China, which is incorporated herein by reference in its entirety.

FIELD OF THE INVENTION

The disclosure relates to the field of display apparatus, and in particular to a display panel and an electronic device comprising the display panel.

BACKGROUND OF THE INVENTION

With the development of the science and technology, electronic devices with displaying function are increasingly widely applied to people's routine production and life. Generally, a display panel for displaying includes multiple pixel units arranged in an array, each pixel row is scanned and driven via a corresponding gate line, and a data signal is provided to each pixel unit in the currently scanned pixel row via a corresponding data line, thereby displaying an image.

In a display panel, generally one pixel row is scanned and driven via one corresponding gate line, while one pixel row includes multiple pixel units, resulting in a slow response speed of the display panel during a scanning process.

BRIEF SUMMARY OF THE INVENTION

In order to solve the problem described above, a display panel and an electronic device are provided according to the disclosure, to improve a response speed of the display panel.

For this purpose, a display panel is provided according to the disclosure, including:

- multiple pixel units arranged in an array;
- multiple data lines for providing data signals for the multiple pixel units;
- multiple gate lines for providing gate scanning signals for the multiple pixel units; and
- at least one enhancing region, where at least one gate signal enhancing transistor and at least one of the multiple pixel units are disposed in the at least one enhancing region.

According to the above description, the display panel according to the disclosure is provided with the gate signal enhancing transistor, which may pre-charge a gate line for a pixel row where the gate signal enhancing transistor is located, thereby improving a response speed of the display panel. In addition, through the gate signal enhancing transistor, the load of a gate drive circuit disposed at a border region of the display panel may be relieved, thereby simplifying the gate drive circuit and shrinking the border region. The electronic device including the display panel has a quick response speed and a narrow border region.

BRIEF DESCRIPTION OF THE DRAWINGS

In order to illustrate the technical solutions in the embodiments of the invention or the conventional technology more clearly, hereinafter the drawings for the description of the embodiments or the conventional technology are introduced simply. Apparently, the drawings described below illustrate only embodiments of the invention, and other drawings may be obtained based on the provided drawings by those skilled in the art without any creative work.

DETAILED DESCRIPTION OF THE INVENTION

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

Hereinafter the technical solutions of the embodiments of the invention will be described clearly and completely in conjunction with the drawings of the embodiments of the invention. Apparently, the described embodiments are only some of the embodiments of the invention, but not all the embodiments. Any other embodiments obtained based on the embodiments of the invention by those skilled in the art without any creative work fall within the scope of the disclosure.

As described in the background, in the conventional display panel, one pixel row is scanned and driven via one corresponding gate line while one pixel row includes multiple pixel units, resulting in a slow response speed of the display panel during a scanning process.

In order to solve the problem described above, it is researched by the inventors that: a gate signal enhancing transistor may be provided to pre-charge a gate line for a pixel row where the gate signal enhancing transistor is located, so as to improve a response speed of the display panel. The pixel row where the gate signal enhancing transistor is located is pre-charged via the gate signal enhancing transistor; when the pixel row is scanned, the pre-charged pixel row can be started to display only after a short period of time, thereby improving the response speed; and the pixel row may be driven with a low scanning power consumption, thereby reducing a volume of a gate drive circuit and reducing an area of a border region of the display panel.

Based on the above research, a display panel is provided according to an embodiment of the invention, including:

- multiple pixel units arranged in an array;
- multiple data lines for providing data signals for the pixel units;
- multiple gate lines for providing gate scanning signals for the pixel units; and at least one enhancing region, where at least one gate signal enhancing transistor and at least one of the pixel units are disposed in the enhancing region, the gate signal enhancing transistor is configured to pre-charge a gate line for a pixel row where the gate signal enhancing transistor is located.

Since the display panel is provided with the gate signal enhancing transistor, the response speed of the display panel is improved and the load of the gate drive circuit is also reduced, thereby simplifying the gate drive circuit and decreasing the border region.

Figure 1:
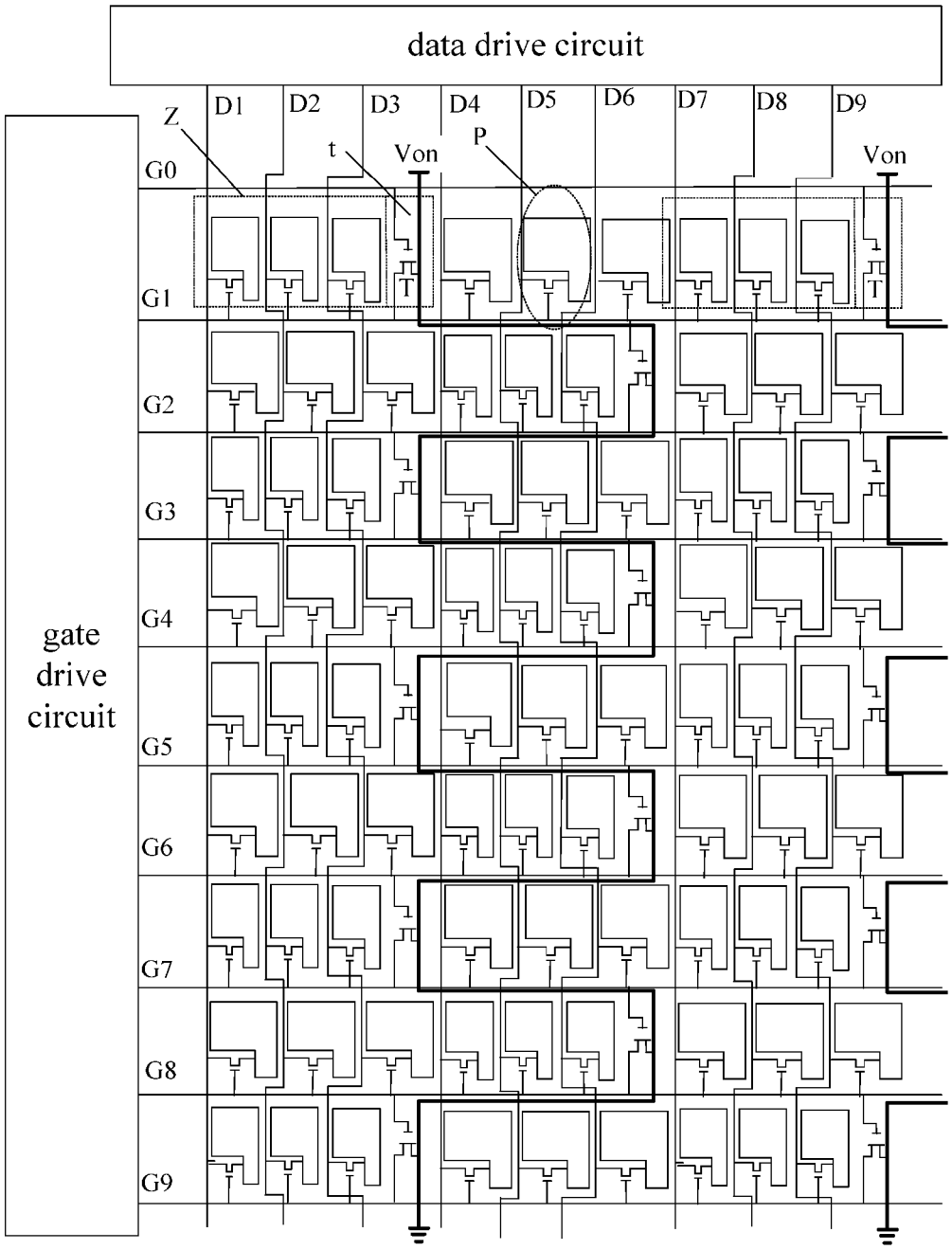
FIG. 1 is a schematic structural diagram of a display panel according to an embodiment of the invention.

The structure of the display panel described in the embodiment is shown in FIG. 1 which is a schematic structural diagram of the display panel according to an embodiment of the invention. The display panel includes M×N pixel units P arranged in an array, M gate lines and N data lines, where M and N are positive integers. In the embodiment, it is illustrated by taking M=N=9 as an example. The display panel includes: a first gate line G1 to a ninth gate line G9; and a first data line D1 to a ninth data line D9. A scanning signal is provided for each gate line via the gate drive circuit, and a data signal is provided for each data line via a data drive circuit.

The display panel includes at least one enhancing region Z, where at least one gate signal enhancing transistor T and at least one of the pixel units P are disposed in the enhancing region Z, and the gate signal enhancing transistor T is configured to pre-charge a gate line for a pixel row where the gate signal enhancing transistor T is located. The enhancing region Z includes a region t where the gate signal enhancing transistor T is disposed.

The gate signal enhancing transistor T includes a first input terminal, a second input terminal and a control terminal. The first input terminal of the gate signal enhancing transistor T is connected to the gate line of the pixel row where the gate signal enhancing transistor is located, the second input terminal of the gate signal enhancing transistor T is connected to a pre-charging voltage Von, and the control terminal of the gate signal enhancing transistor T is connected to a control voltage. Before the pixel row where the gate signal enhancing transistor is located is scanned, the control voltage controls to turn on the gate signal enhancing transistor, and the pixel units P in the pixel row are pre-charged via the pre-charging voltage Von. The pre-charging voltage Von has an amplitude lower than that of a turn-on voltage of the pixel units P. The pre-charging voltage Von may be provided by a voltage source provided separately or by the data drive circuit.

For any gate signal enhancing transistor T, before the pixel units P in the pixel row where the gate signal enhancing transistor T is located are scanned, the control voltage controls to turn on the gate signal enhancing transistor, and the pixel units P in the pixel row where the gate signal enhancing transistor T is located are pre-charged via the pre-charging voltage Von. Since the amplitude of the pre-charging voltage Von is less than that of the turn-on voltage of the pixel units P, pixel units P in the pixel row are not turned on; but when the pixel units in the pixel row are scanned, since the pixel units are pre-charged, the gate drive circuit may turn on the pixel units P in the pixel row within a short period of time and with a low power consumption, thereby improving the response speed.

In order to avoid the display defect due to the adjacent arranging of the gate signal enhancing transistors T, in the embodiment, any gate signal enhancing transistor T is neither adjacent to another signal enhancing transistor T in the same pixel row, nor adjacent to another gate signal enhancing transistor T in an adjacent pixel row.

For the gate signal enhancing transistor T located in a first pixel row, the control terminal of the gate signal enhancing transistor T is connected to an auxiliary gate line G0 and the control voltage is provided via the auxiliary gate line G0. The auxiliary gate line G0 is provided in the display panel to provide a scan starting signal. For the gate signal enhancing transistor located in pixel rows other than the first pixel row, the control terminal of the gate signal enhancing transistor is connected to a gate line of a preceding pixel row, and the control voltage is provided via the gate line of the preceding pixel row. For example, for the signal enhancing transistor T in the i-th pixel row, the control terminal of the gate signal enhancing transistor T is connected to an (i−1)th gate line $G_{i-1}$, where i is a positive integer not greater than M. The control voltage is provided for the corresponding gate signal enhancing transistor T via the gate line of the preceding stage or via the auxiliary gate line G0; when scanning the i-th pixel row, the control voltage may be provided for the gate signal enhancing transistor T in the next stage of the pixel row via the i-th gate line $G_i$. When scanning a certain pixel row, the gate signal enhancing transistor T in the next stage of the pixel row may be turned on without providing a separate signal as the control voltage, therefore the implementation is simple.

In the embodiment as shown in FIG. 1, each pixel row is provided with one gate signal enhancing transistor T. Second input terminals of all the gate signal enhancing transistors T are connected to a same signal line for providing the pre-charging voltage Von. The pre-charging voltage is provided to all the gate signal enhancing transistors T via one signal line, hence the wiring is simplified and the control is simple. For the signal line providing the pre-charging voltage to the gate signal enhancing transistors T, one end is connected to a signal source of the pre-charging voltage Von, and the other end is grounded.

Alternatively, each pixel row may be provided with n enhancing regions Z. In this case, each pixel row is provided with n gate signal enhancing transistors, where n is a positive integer greater than 1. Similarly, in order to reduce the number of the signal lines for providing the pre-charging voltage to the gate signal enhancing transistors T, in a row direction of the array, the n gate signal enhancing transistors in the same pixel row are sequentially defined as the first gate signal enhancing transistor to the n-th gate signal enhancing transistor; i-th gate signal enhancing transistors of all the pixel rows are connected to the same signal line; and different gate signal enhancing transistors in the same pixel row are connected to different signal lines.

In the embodiment as shown in FIG. 1, the enhancing region Z includes three pixel units P. The pixel unit P outside the enhancing region Z is defined as pixel unit P1, and the pixel unit P inside the enhancing region Z is defined as pixel unit P2. In this case, referring to FIG. 2, a schematic structural diagram of a layout of the widths of the pixel units P of the display panel shown in FIG. 1 is shown.

Figure 2:
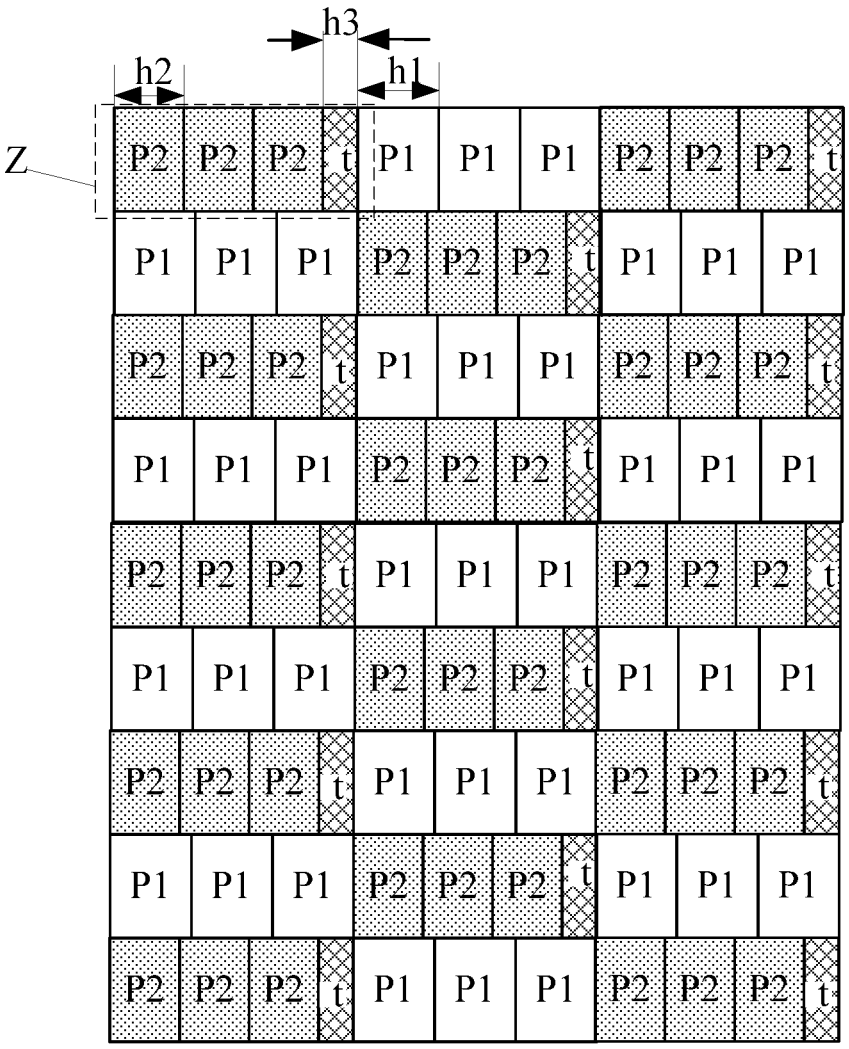
FIG. 2 is a schematic structural diagram of a layout of the widths of pixel units P of the display panel shown in FIG. 1.
Figure 3:
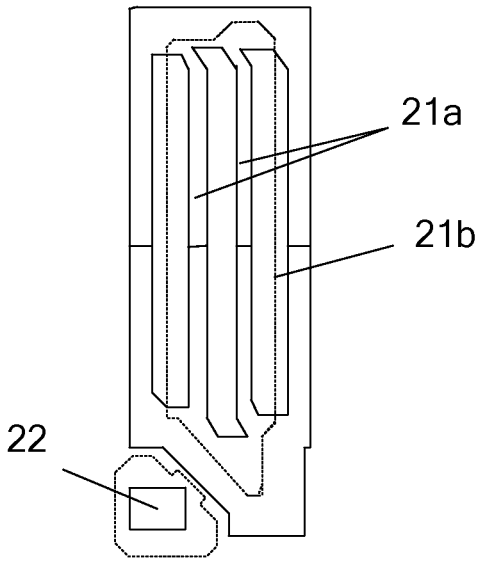
FIG. 3 is a schematic structural diagram of a pixel unit P according to an embodiment of the invention.

Reference is made to FIG. 3 which is a schematic structural diagram of a pixel unit P according to an embodiment of the invention. The pixel unit P includes electrodes and a Thin Film Transistor (TFT) 22 controlling the electrodes. The electrodes include a pixel electrode 21*a* and a common electrode 21*b* arranged opposite to each other. At least one of the pixel electrodes 21*a* and the common electrode 21*b* may be a strip electrode. In the structure shown in FIG. 2, the pixel electrode 21*a* is the strip electrode.

The pixel electrode and the common electrode are ITO electrodes. A wide slit needs to be provided for the strip pixel electrode or strip common electrode. The width of the whole pixel unit P is decreased. Since in the pixel unit P there is a slit having a width greater than the width of the strip electrode, the reduction in area of the slit is larger than the reduction in the area of the electrode, and decreasing the width of the pixel unit P has little influence on the transmittance for the whole pixel unit P.

The number of the pixel units in the enhancing region Z is not limited to the number in the embodiment shown in FIG. 1, and the enhancing region Z may include m pixel units, where m is a positive integer. The width of the pixel unit P2 located in the enhancing region Z is less than the width of the pixel unit P1 located outside the enhancing region Z. A sum of the widths of the m pixel units P2 and a width of the at least one gate signal enhancing transistor in the enhancing region Z equals to a sum of the widths of m pixel units P1 located outside the enhancing region Z. In this way, the space may be saved to dispose the gate signal enhancing transistor T, no extra display area is occupied and little influence occurs on the transmittance of the display panel.

It is searched that a difference (h1−h2) between the width h1 of the pixel unit P1 located outside the enhancing region Z and the width h2 of the pixel unit P2 located in the enhancing region Z ranges from 0.5 μm to 2.5 μm, end points included. In this case, within the range of the semiconductor process, one gate signal enhancing transistor T may be accommodated in the width h3 saved by the three adjacent pixel units P2, to pre-charge the pixel units P in a pixel row where the gate signal enhancing transistor T is located, where h3=h1−h2.

Figure 4A:
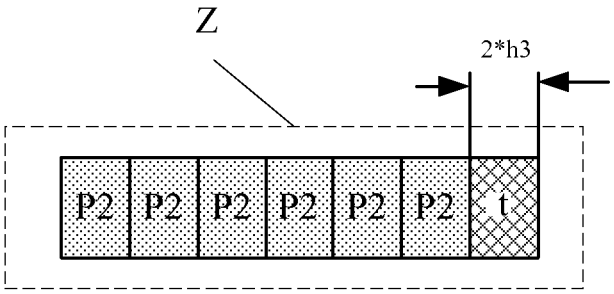
FIGS. 4*a* and 4*b* are schematic structural diagrams of an enhancing region according to an embodiment of the invention.
Figure 4B:
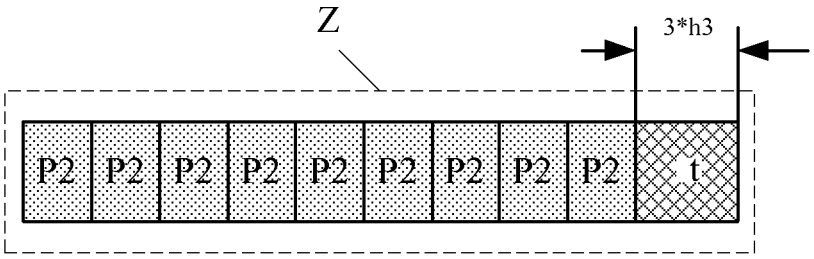

For the RGB display mode, three adjacent pixel units with different colors are defined as one display unit, in this case, m is an integral multiple of 3. The enhancing region Z may include one display unit as shown in FIG. 2; or the enhancing region Z may include two display units as shown in FIG. 4*a*, and in this case the width of the region t is 2*h3; or the enhancing region Z may include three display units as shown in FIG. 4*b*, and in this case the width of the region t is 3*h3. The enhancing region Z is configured to include multiple display units, thereby the enhancing region Z includes more pixel units P2, and the region t is large enough to facilitate the fabrication of the gate signal enhancing transistor T and the layout of the wiring.

In other embodiments, the display panel of the disclosure may also be applied to the RGBW display mode. In this case, one display unit includes four successively-arranged pixel units R, G, B and W. In this case, a region occupied by one gate signal enhancing transistor may be provided by shrinking at least one adjacent set of RGBW pixel units simultaneously.

In the case that the enhancing region Z includes multiple display units, the gate signal enhancing transistor T may be disposed between two display units or at either end of the enhancing region Z.

The pixel unit P is driven by a TFT, and in the display panel a turn-on voltage of the TFT is greater than 30V. Hence, in the embodiment, the pre-charging voltage ranges from 1.0V to 3.0V, end points included, such that the pre-charging is achieved while the pixel unit P not in the currently scanned pixel row would not be started due to the pre-charging.

According to the above description, in the display panel of the embodiment of the invention, the space for disposing the gate signal enhancing transistor T is saved by decreasing the width of the pixel units P, such that the pixel units P in the pixel row next to the currently scanned pixel row are pre-charged, the response speed of the display panel may be improved and the output power consumption of the gate drive circuit may be reduced, thereby simplifying the gate drive circuit and shrinking the border region.

Figure 5:
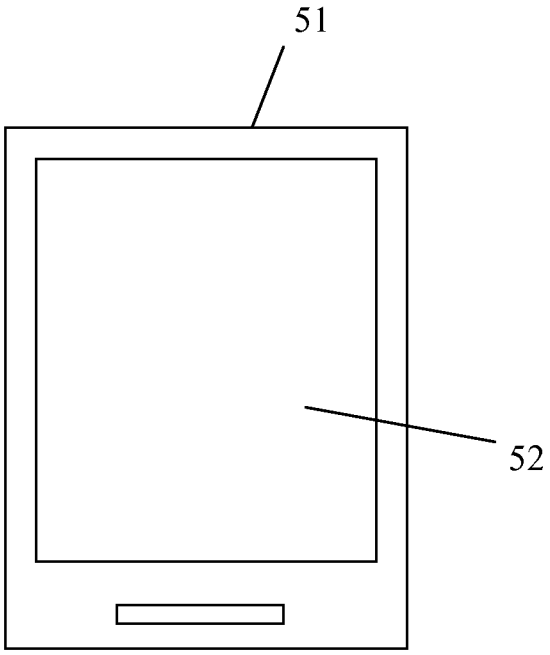
FIG. 5 is a schematic structural diagram of an electronic device according to an embodiment of the invention.

Reference is made to FIG. 5 which is a schematic structural diagram of an electronic device 51 according to an embodiment of the invention. The electronic device 51 includes a display panel 52 which is the display panel described in any one of the above embodiments. The electronic device may be a mobile phone, a tablet computer or a wearable electronic device with a display screen.

The electronic device including the above described display panel responds quickly in case of displaying, and has a narrow border region. For the display panel with the same size, an area of the display region of the display panel according to the disclosure is larger.

The above description of the disclosed embodiments enables those skilled in the art to implement or practice the disclosure. Various changes to these embodiments are apparent for those skilled in the art, and the general principles defined herein may be implemented in other embodiments without departing from the spirit or scope of the disclosure. Hence, the disclosure is not limited to these embodiments disclosed herein, but claims a widest scope consistent with the principles and novel features disclosed herein.

The invention claimed is:

1. A display panel comprising:

a plurality of pixel units arranged in an array;

a plurality of data lines for providing data signals for the plurality of pixel units;

a plurality of gate lines for providing gate scanning signals for the plurality of pixel units; and at least one enhancing region, wherein at least one gate signal enhancing transistor and at least one of the plurality of pixel units are disposed in the at least one enhancing region, wherein the at least one gate signal enhancing transistor includes a first input terminal, a second input terminal and a control terminal, and is configured to be neither adjacent to a second gate signal enhancing transistor in a same pixel row, nor adjacent to a third gate signal enhancing transistor in an adjacent pixel row, wherein the first input terminal of the at least one gate signal enhancing transistor is connected to a gate line for a pixel row where the at least one gate signal enhancing transistor is located;

the second input terminal of the at least one gate signal enhancing transistor is connected to a pre-charging voltage; and the control terminal of the at least one gate signal enhancing transistor is connected to a gate line of another pixel row providing a control voltage; before the pixel row where the at least one gate signal enhancing transistor is located is scanned, the control voltage controls to turn on the at least one gate signal enhancing transistor and the plurality of pixel units in the pixel row where the at least one gate signal enhancing transistor is located are pre-charged via the pre-charging voltage, where an amplitude of the pre-charging voltage is less than that of a turn-on voltage of the pixel units.

2. The display panel according to claim 1, wherein the control terminal of the at least one gate signal enhancing transistor is connected to an auxiliary gate line in the case that the at least one gate signal enhancing transistor is located in a first pixel row, wherein the control voltage is provided via the auxiliary gate line; and the control terminal of the gate signal enhancing transistor is connected to a gate line of a preceding pixel row in the case that the at least one gate signal enhancing transistor is located in pixel rows other than the first pixel row, wherein the control voltage is provided via the gate line of the preceding pixel row.

3. The display panel according to claim 1, wherein each pixel row is provided with one gate signal enhancing transistor.

4. The display panel according to claim 3, wherein second input terminals of all the gate signal enhancing transistors are connected to a same signal line for providing the pre-charging voltage.

5. The display panel according to claim 1, wherein each pixel row is provided with n gate signal enhancing transistors, where n is a positive integer greater than 1.

6. The display panel according to claim 5, wherein in a row direction of the array, the n gate signal enhancing transistors in the same pixel row are sequentially defined as a first gate signal enhancing transistor to an n-th gate signal enhancing transistor;

i-th gate signal enhancing transistors of all the pixel rows are connected to a same signal line, and different gate signal enhancing transistors in the same pixel row are connected to different signal lines, wherein i is an integer number which is more than 1 and less than n; and the signal lines are configured to provide the pre-charging voltage.

7. The display panel according to claim 1, wherein the enhancing region comprises m pixel units, where m is a positive integer; and the pixel unit located in the enhancing region has a width less than that of the pixel unit located outside the enhancing region.

8. The display panel according to claim 7, wherein a sum of the widths of the m pixel units and a width of the at least one gate signal enhancing transistor in the enhancing region equals to a sum of the widths of m pixel units located outside the enhancing region.

9. The display panel according to claim 8, wherein in the case that the enhancing region comprises a plurality of display units, the gate signal enhancing transistor is arranged between two display units or at either end of the enhancing region.

10. The display panel according to claim 1, wherein the pre-charging voltage ranges from 1.0 V to 3.0V.

11. The display panel according to claim 7, wherein a difference between the width of the pixel unit located outside the enhancing region and the width of the pixel unit located in the enhancing region ranges from 0.5 μm to 2.5 μm.

12. The display panel according to claim 11, wherein three adjacent pixel units with different colors are defined as one display unit, and the enhancing region comprises one display unit, two display units or three display units.

13. An electronic device comprising a display panel, wherein the display panel comprises:

a plurality of pixel units arranged in an array;

a plurality of data lines for providing data signals for the plurality of pixel units;

a plurality of gate lines for providing gate scanning signals for the plurality of pixel units; and at least one enhancing region, wherein at least one gate signal enhancing transistor and at least one of the plurality of pixel units are disposed in the at least one enhancing region, wherein the at least one gate signal enhancing transistor includes a first input terminal, a second input terminal, and a control terminal, and is configured to be neither adjacent to a second gate signal enhancing transistor in a same pixel row, nor adjacent to a third gate signal enhancing transistor in an adjacent pixel row, wherein the first input terminal of the at least one gate signal enhancing transistor is connected to a gate line for a pixel row where the at least one gate signal enhancing transistor is located;

the second input terminal of the at least one gate signal enhancing transistor is connected to a pre-charging voltage; and the control terminal of the at least one gate signal enhancing transistor is connected to a gate line of another pixel row providing a control voltage; before the pixel row where the at least one gate signal enhancing transistor is located is scanned, the control voltage controls to turn on the at least one gate signal enhancing transistor and the plurality of pixel units in the pixel row where the at least one gate signal enhancing transistor is located are pre-charged via the pre-charging voltage, where an amplitude of the pre-charging voltage is less than that of a turn-on voltage of the pixel units.

14. The electronic device according to claim 13, wherein the electronic device is a mobile phone, a tablet computer or a wearable electronic device with a display screen.

* * * * *